US007037160B2

(12) United States Patent
Sreeram et al.

(10) Patent No.: US 7,037,160 B2
(45) Date of Patent: May 2, 2006

(54) METHODS TO IMPROVE INSULATOR PERFORMANCE FOR CATHODE-RAY TUBE (CRT) APPLICATIONS

(75) Inventors: Attiganal Narayanaswamy Sreeram, Princeton, NJ (US); Leszek Hozer, Plainsboro, NJ (US)

(73) Assignee: Thomson Licensing, Boulogne-Billancourt (FR)

( * ) Notice: Subject to any disclaimer, the term of this patent is extended or adjusted under 35 U.S.C. 154(b) by 0 days.

(21) Appl. No.: 10/873,335

(22) Filed: Jun. 22, 2004

(65) Prior Publication Data

US 2004/0235386 A1 Nov. 25, 2004

Related U.S. Application Data

(62) Division of application No. 09/741,537, filed on Dec. 20, 2000, now Pat. No. 6,784,606.

(51) Int. Cl.
*H01J 9/236* (2006.01)

(52) U.S. Cl. ..... 445/30; 455/37

(58) Field of Classification Search ..... 445/24, 445/37, 47, 30; 313/402–408
See application file for complete search history.

(56) References Cited

U.S. PATENT DOCUMENTS 5,625,251 A * 4/1997 Nosker et al. ..... 313/403
5,646,478 A * 7/1997 Nosker et al. ..... 313/402
5,647,653 A * 7/1997 Cherukuri ..... 313/402
6,597,093 B1 * 7/2003 Yang ..... 313/402
6,628,057 B1 * 9/2003 Thaler et al. ..... 313/407
6,642,643 B1 * 11/2003 Cohee et al. ..... 313/402
6,677,700 B1 * 1/2004 Benigni et al. ..... 313/402
6,720,719 B1 * 4/2004 Bartch et al. ..... 313/402
6,784,606 B1 * 8/2004 Sreeram et al. ..... 313/402
2002/0074923 A1 6/2002 Sreeram et al. ..... 313/402
2002/0074924 A1 6/2002 Cohee et al. ..... 313/402
2002/0079811 A1 6/2002 Thaler et al. ..... 313/407
2002/0125810 A1 9/2002 Garrity, Jr. et al. ..... 313/408
2004/0000855 A1 * 1/2004 Benigni et al. ..... 313/402

* cited by examiner

*Primary Examiner*—Joseph Williams
*Assistant Examiner*—Dalei Dong
(74) *Attorney, Agent, or Firm*—Joseph S. Tripoli; Harvey D. Fried; Patricia A. Verlangieri

(57) ABSTRACT

A color cathode-ray tube (CRT) having an evacuated envelope with an electron gun therein for generating at least one electron beam is provided. The envelope further includes a faceplate panel having a luminescent screen with phosphor elements on an interior surface thereof. A focus mask, having a plurality of spaced-apart first conductive strands, is located adjacent to an effective picture area of the screen. The spacing between the first conductive strands defines a plurality of apertures substantially parallel to the phosphor elements on the screen. Each of the first conductive strands has a substantially continuous insulating material layer formed on a screen facing side thereof. A plurality of second conductive wires are oriented substantially perpendicular to the plurality of first conductive strands and are bonded thereto by the insulating material layer. The insulating material layer comprises a low porosity lead-zinc-borosilicate glass.

6 Claims, 4 Drawing Sheets

METHODS TO IMPROVE INSULATOR PERFORMANCE FOR CATHODE-RAY TUBE (CRT) APPLICATIONS

CROSS-REFERENCE TO RELATED APPLICATIONS

This application is a divisional application of U.S. patent application Ser. No. 09/741,537 filed Dec. 20, 2000 now U.S. Pat. No. 6,784,606.

BACKGROUND OF THE INVENTION

1. Field of the Invention

This invention relates to a color cathode-ray tube (CRT) and, more particularly to a color CRT including a focus mask.

2. Description of the Background Art

A color cathode-ray tube (CRT) typically includes an electron gun, an aperture mask, and a screen. The aperture mask is interposed between the electron gun and the screen. The screen is located on an inner surface of a faceplate of the CRT tube. The screen has an array of three different color-emitting phosphors (e.g., green, blue, and red) formed thereon. The aperture mask functions to direct electron beams generated in the electron gun toward appropriate color-emitting phosphors on the screen of the CRT tube.

The aperture mask may be a focus mask. Focus masks typically comprise two sets of conductive lines (or wires) that are arranged approximately orthogonal to each other, to form an array of openings. Different voltages are applied to the two sets of conductive lines to create multipole focusing lenses in each opening of the mask. The multipole focusing lenses are used to direct the electron beams toward the color-emitting phosphors on the screen of the CRT tube.

One type of focus mask is a tensioned focus mask, wherein at least one of two sets of conductive lines is under tension. Typically, for tensioned focus masks, the vertical set of conductive lines is under tension, with the horizontal set of conductive lines overlying such vertical tensioned lines.

Where the two sets of conductive lines overlap, such conductive lines are typically attached at their crossing points (junctions) by an insulating material. When the different voltages are applied between the two sets of conductive lines of the mask, to create the multipole focusing lenses in the openings thereof, high voltage (HV) flashover may occur at one or more junctions. HV flashover is the dissipation of an electrical charge across the insulating material separating the two sets of conducting lines. HV flashover is undesirable because it may cause an electrical short circuit between the two sets of conductive lines, leading to subsequent failure of the focus mask.

Also, when the electron beams from the electron gun are directed toward the color-emitting phosphors on the screen, backscattered electrons from the screen may cause the insulator material on the focus mask to accumulate an electrical charge. Such charging is undesirable because it may interfere with the ability of the focus mask to direct the electron beams toward the color-emitting phosphors formed on the screen, as well as cause HV flashover between the conductive lines of the focus mask.

Thus, a need exists for suitable insulating materials that overcome the above-mentioned drawbacks.

SUMMARY OF THE INVENTION

The present invention relates to a color cathode-ray tube (CRT) having an evacuated envelope with an electron gun therein for generating at least one electron beam. The envelope further includes a faceplate panel having a luminescent screen with phosphor elements on an interior surface thereof. A focus mask, having a plurality of spaced-apart first conductive strands, is located adjacent to an effective picture area of the screen. The spacing between the first conductive strands defines a plurality of apertures substantially aligned with the phosphor elements on the screen. Each of the first conductive strands has a substantially continuous insulating material layer formed on a screen facing side thereof. A plurality of second conductive wires are oriented substantially perpendicular to the plurality of first conductive strands and are bonded thereto by the insulating material layer. The insulating material layer comprises a low porosity lead-zinc-borosilicate glass.

BRIEF DESCRIPTION OF THE DRAWING

The invention will now be described in greater detail, with relation to the accompanying drawing, in which.

DETAILED DESCRIPTION OF THE PREFERRED EMBODIMENT

Figure 1:
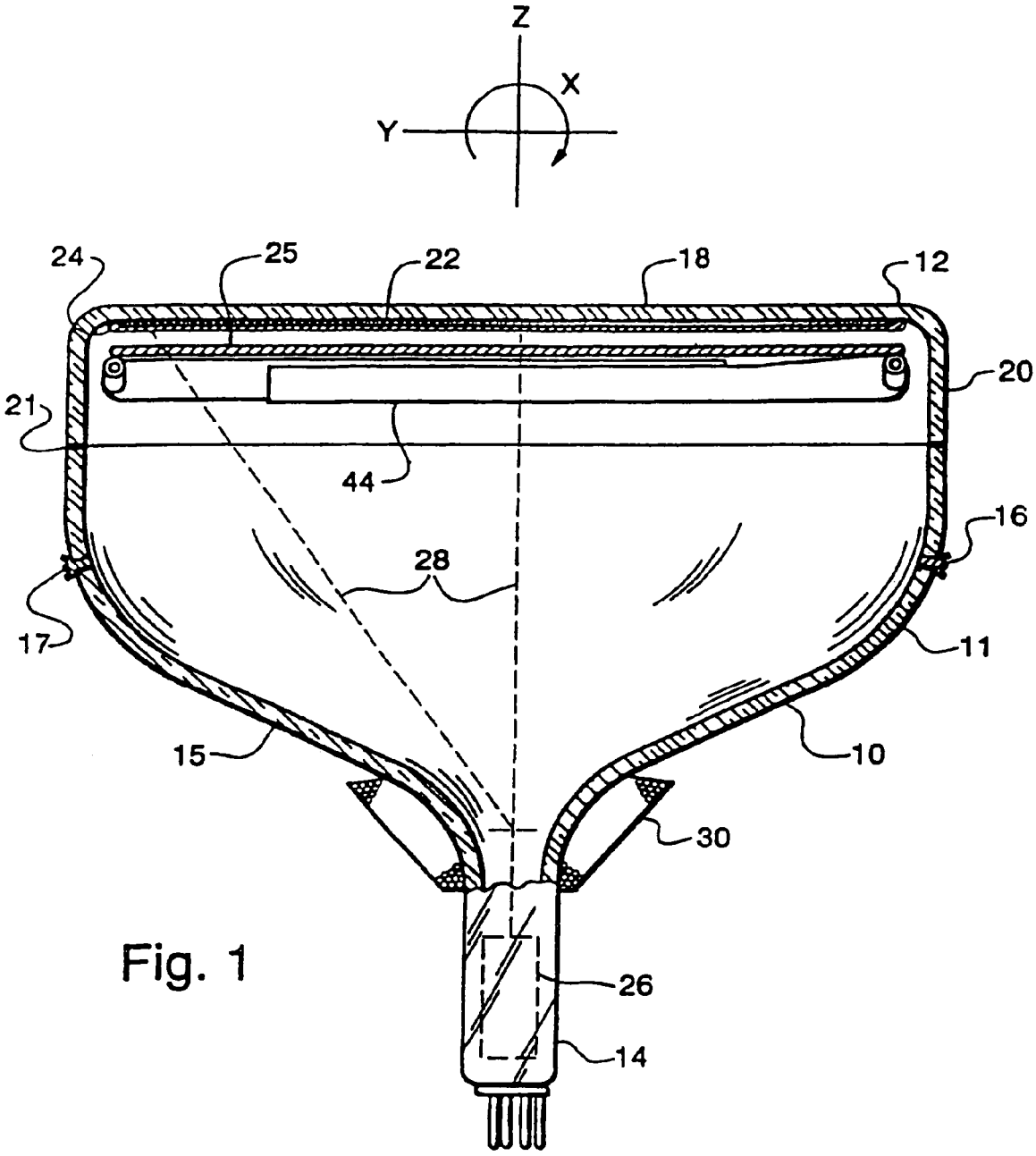
FIG. 1 is a plan view, partly in axial section, of a color cathode-ray tube (CRT). including a focus mask-frame assembly embodying the present invention.

FIG. 1 shows a color cathode-ray tube (CRT) 10 having a glass envelope 11 comprising a faceplate panel 12 and a tubular neck 14 connected by a funnel 15. The funnel 15 has an internal conductive coating (not shown) that is in contact with, and extends from, a first anode button 16 to the neck 14. A second anode button 17, located opposite the first anode button 16, is not contacted by the conductive coating.

The faceplate panel 12 comprises a viewing faceplate 18 and a peripheral sidewall 20, or skirt that is sealed to the funnel 15 by a glass frit 21. A three-color luminescent screen 22 of phosphor elements is coated onto the inner surface of the faceplate 18. The screen 22 is a line screen, shown in detail in FIG. 5, that includes a multiplicity of screen elements comprising red-emitting, green-emitting, and blue-emitting phosphor elements, R, G, and B, respectively, arranged in triads, each triad including a phosphor line of each of the three colors. Preferably, a light-absorbing matrix 23 separates the phosphor elements. A thin conductive layer 24, preferably made of aluminum, overlies the screen 22 on the side away from the faceplate 18, and provides means for applying a uniform first anode potential to the screen as well as for reflecting light, emitted from the phosphor elements, through the faceplate 18.

A cylindrical multi-aperture color selection electrode, or focus mask 25, is mounted, by conventional means, within the faceplate panel 12, in predetermined spaced relation to the screen 22. An electron gun 26, shown schematically by the dashed lines in FIG. 1, is centrally mounted within the neck 14 to generate and direct three inline electron beams 28, a center and two side or outer beams, along convergent paths through the focus mask 25 to the screen 22. The inline direction of the center beam 28 is approximately normal to the plane of the paper.

The CRT of FIG. 1 is designed to be used with an external magnetic deflection yoke, such as the yoke 30, shown in the neighborhood of the funnel-to-neck junction. When activated, the yoke 30 subjects the three electron beams to magnetic fields that cause the beams to horizontally and vertically scan a rectangular raster across the screen 22.

The focus mask 25 is formed, preferably, from a thin rectangular sheet of about 0.05 mm (2 mil) thick low carbon steel (about 0.005% carbon by weight). Suitable materials for the focus mask 25 may include high expansion, low carbon steels having a coefficient of thermal expansion (CTE) within a range of about $120–160\times10^{-7}/°$ C.; intermediate expansion alloys such as, iron-cobalt-nickel (e.g., KOVAR™) having a coefficient of thermal expansion within a range of about $40–60\times10^{-7}/°$ C.; as well as low expansion alloys such as, iron-nickel (e.g., INVART™) having a coefficient of thermal expansion within a range of about $9–30\times10^{-7}/°$ C.

Figure 2:
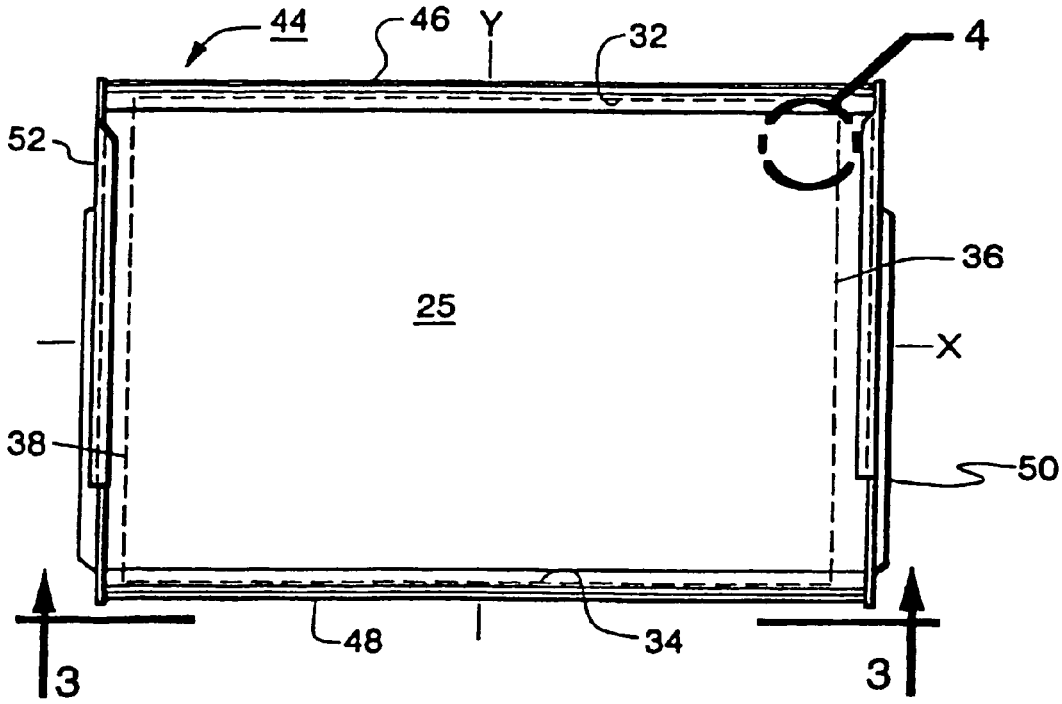
FIG. 2 is a plan view of the focus mask-frame assembly of FIG. 1.

As shown in FIG. 2, the focus mask 25 includes two horizontal sides 32, 34 and two vertical sides 36, 38. The two horizontal sides 32, 34 of the focus mask 25 are parallel with the central major axis, X, of the CRT while the two vertical sides 36, 38 are parallel with the central minor axis, Y, of the CRT.

Figure 4:
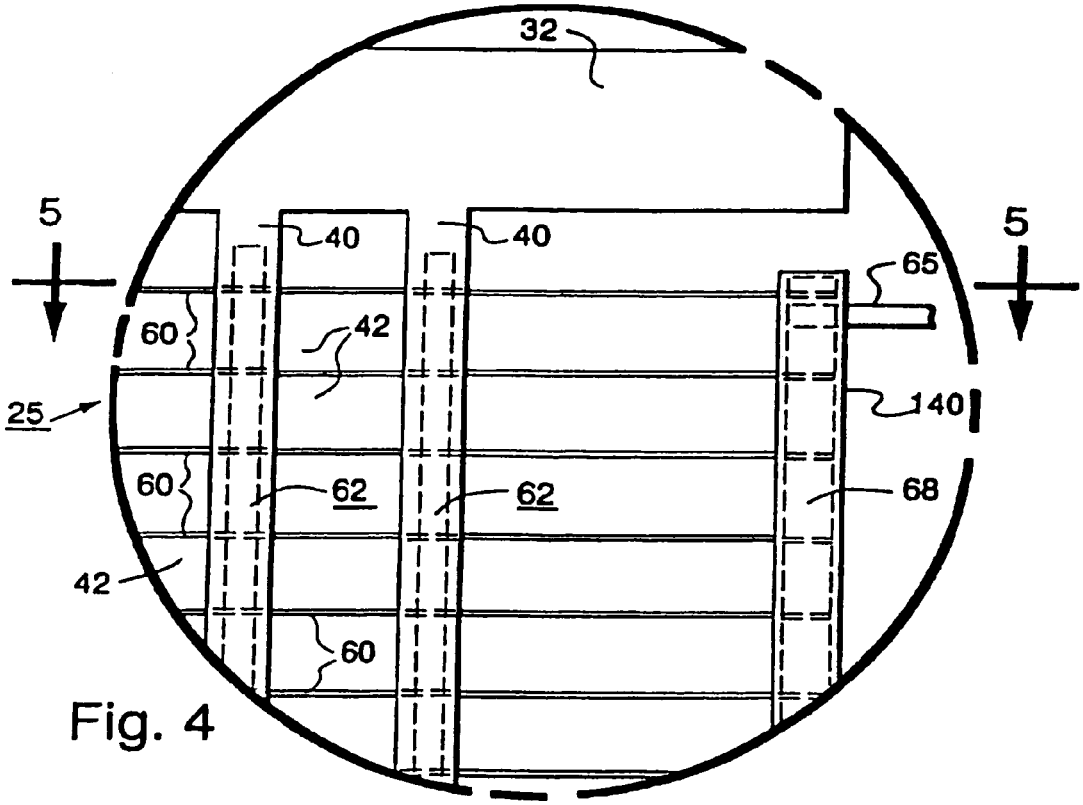
FIG. 4 is an enlarged section of the focus mask shown within the circle 4 of FIG. 2.

The focus mask 25 (shown schematically by the dashed lines in FIG. 2) includes an apertured portion that is adjacent to and overlies an effective picture area of the screen 22. Referring to FIG. 4, the focus mask 25 includes a plurality of first conductive metal strands 40 (conductive lines), each having a transverse dimension, or width, of about 0.3 mm to about 0.5 mm (12–20 mils) separated by spaced apertures 42, each having a width of about 0.27 mm to about 0.43 mm (11–16 mils) that parallel the minor axis, Y, of the CRT and the phosphor elements of the screen 22. For a color CRT having a diagonal dimension of 68 cm, the first metal strands have widths in a range of about 0.30 mm to about 0.38 mm (12–14.5 mils) and an aperture 42 width of about 0.27 mm to about 0.33 mm (11–13.3 mils). In a color CRT having a diagonal dimension of 68 cm (27 V), there are about 760 of the first metal strands 40. Each of the apertures 42 extends from one horizontal side 32 of the mask to the other horizontal side 34 thereof (not shown in FIG. 4).

Figure 3:
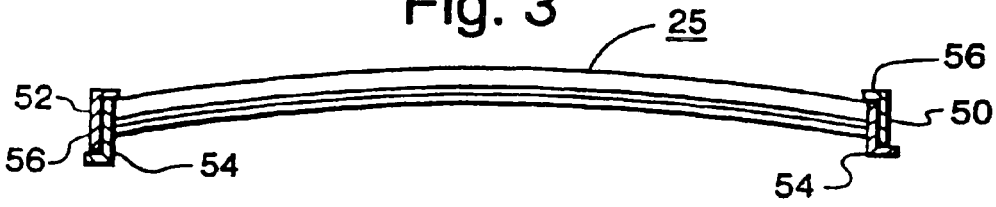
FIG. 3 is a front view of the mask-frame assembly taken along line 3—3 of FIG. 2.

A frame 44, for the focus mask 25, is shown in FIGS. 1–3, and includes four major members, two torsion tubes or curved members 46, 48 and two tension arms or straight members 50, 52. The two curved members 46, 48 are parallel to the major axis, X, and each other.

As shown in FIG. 3, each of the straight members 50, 52 include two overlapped partial members or parts 54, 56, each part having an L-shaped cross-section. The overlapped parts 54, 56 are welded together where they are overlapped. An end of each of the parts 54, 56 is attached to an end of one of the curved members 46, 48. The curvature of the curved members 46, 48 matches the cylindrical curvature of the focus mask 25. The horizontal sides 32, 34 of the focus mask 25 are welded between the two curved members 46, 48, which provides the necessary tension to the mask. Before welding the horizontal sides 32, 34 of the focus mask 25 to the frame 44, the mask material is pre-stressed and blackened by tensioning the mask material while heating it, in a controlled atmosphere of nitrogen and oxygen, at a temperature of about 500° C., for about 120 minutes. The frame 44 and mask material, when welded together, comprise a mask assembly.

Figure 5:
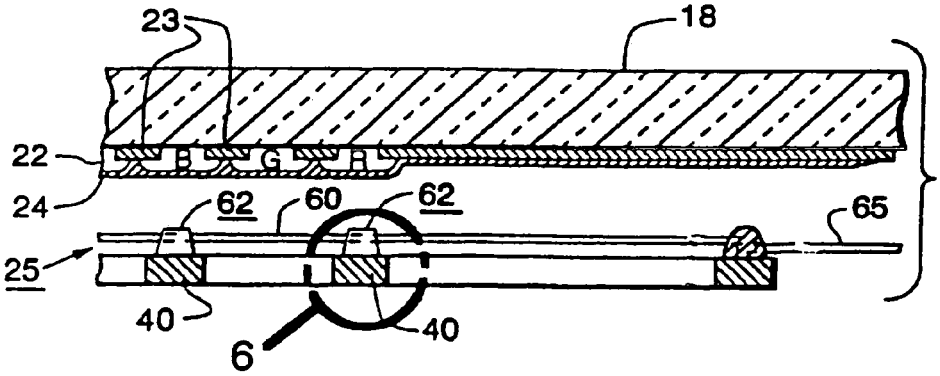
FIG. 5 is a view of the focus mask and the luminescent screen taken along lines 5—5 of FIG. 4.

With reference to FIGS. 4 and 5, a plurality of second conductive metal wires (cross wires) 60, each having a diameter of about 0.025 mm (1 mil), are disposed substantially perpendicular to the first metal strands 40 and are spaced therefrom by an insulator 62, formed on the screen-facing side of each of the first metal strands 40. The second metal wires 60 form cross members that facilitate the application of a second anode, or focusing, potential to the focus mask 25. Suitable materials for the second metal wires include iron-nickel alloys such as, INVAR™ and/or carbon steels such as, HyMu80 wire (commercially available from Carpenter Technology, Reading, Pa).

The vertical spacing, or pitch, between adjacent second metal wires 60 is about 0.33 mm (13 mils) for a color CRT having a diagonal dimension of 68 cm (27 V). The relatively thin second metal wires 60 (as compared to the first metal strands 40) provide the essential focusing function of the focus mask 25, without adversely affecting the electron beam transmission thereof. The focus mask 25, described herein, provides a mask transmission, at the center of the screen 22, of about 40–45%, and requires that the second anode, or focusing, voltage, $\Delta V$, applied to the second metal wires 60, differs from the first anode voltage applied to the first metal strands 40 by less than about 1 kV, for a first anode voltage of about 30 kV.

The insulators 62, shown in FIG. 4, are disposed substantially continuously on the screen-facing side of each of the first metal strands 40. The second metal wires 60 are bonded to the insulators 62, to electrically isolate the second metal wires 60 from the first metal strands 40.

The insulators 62 are formed of a suitable material that has a thermal expansion coefficient that is matched to the material of the focus mask 25. The material of the insulators 62 should preferably have a relatively low melting temperature so that it may flow, harden, and adhere to both the first metal strands 40 and the second metal wires 60, within a temperature range of about 450° C. to about 500° C. The insulator material should also preferably have a dielectric breakdown strength of about 40000 V/mm (1000 V/mil), with bulk and surface resistivities of about $10^{11}$ ohm-cm and $10^{12}$ ohm/square, respectively. Additionally, the insulator material should be stable at temperatures used for sealing the CRT faceplate panel 12 to the funnel (temperatures of about 450° C. to about 500° C.), as well as having adequate mechanical strength and elastic modulus, and be low outgassing during processing and operation for an extended period of time under electron beam bombardment.

The insulators 62 are formed of a low porosity lead-zinc-borosilicate glass. The low porosity lead-zinc-borosilicate glass was formed using a lead-zinc-borosilicate glass powder having a median particle size less than about 1 μm.

The use of a median particle size less than about 1 μm increases the packing density of the insulator material, reducing the crystallite size therein. It is believed that reducing the crystallite size in the insulator material also reduces radiation damaged regions therein, such that charge accumulation under electron beam bombardment is reduced.

The smaller median particle size for the lead-zinc-borosilicate glass additionally provides a substantially smooth surface for the insulators. It is believed that the substantially smooth surface is advantageous for insulator behavior, since sharp features are minimized, thereby reducing the number of initiation points for Hv breakdown.

The low porosity lead-zinc-borosilicate glass optionally includes one or more transition metal oxides. The one or more transition metal oxides can either be melted with the lead-zinc-borosilicate glass or mixed together with a lead-zinc-borosilicate glass powder. The addition of the one or more transition metal oxides to the low porosity lead-zinc-borosilicate glass is believed to slightly increase the electrical conductivity of the insulator material, such that it does not accumulate charge under electron beam bombardment.

The weight percent of the one or more transition metal oxides in the low porosity lead-zinc-borosilicate glass is used to control the electrical conductivity of the insulator material. The weight percent of the one or more transition metal oxides in the low porosity lead-zinc-borosilicate glass is preferably within a range of about 2% by weight to about 12% by weight.

Suitable lead-zinc-borosilicate glasses include SCC-11 glass powder commercially available from SEM-Com, Toledo, Ohio. The SCC-11 glass powder, as purchased, typically has a median particle size of about 3.5 μm. The 3.5 μm SCC-11 glass powder may be milled to reduce the median particle size thereof to less than about 1.0 μm.

Suitable transition metal oxides include iron oxides ($Fe_2O_3$ and $Fe_3O_4$), molybdenum oxide ($MoO_3$), titanium oxide ($TiO_2$), zinc oxide (ZnO), chromium oxide ($Cr_2O_3$), nickel oxide (NiO), and tin oxide ($SnO_2$), among others.

Figure 6:
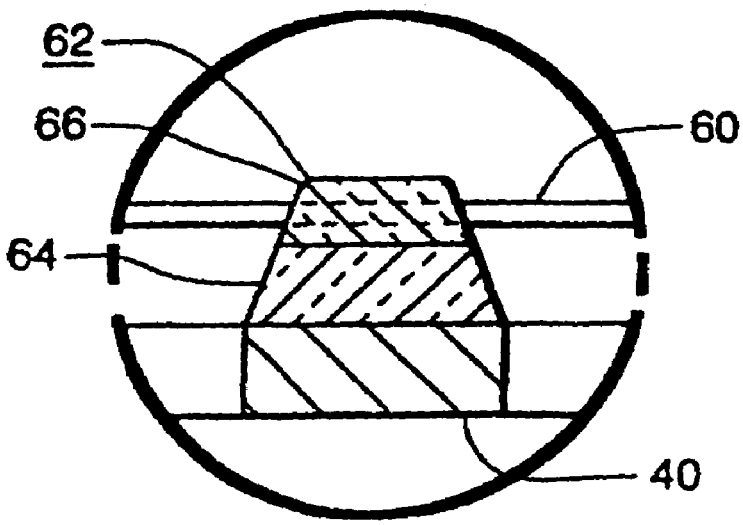
FIG. 6 is an enlarged view of a portion of the focus mask shown within the circle of FIG. 5.

According to a preferred method of making the focus mask 25, and referring to FIG. 6, a first coating of the insulator 64 is provided, e.g., by spraying, onto the screen-facing side of the first metal strands 40. The first metal strands 40, in this example, are formed of a flat tension mask steel (FTM), having a coefficient of thermal expansion within the range of $110–150\times10^{-7}/°$ C. The first insulator coating, for example, may be a low porosity lead-zinc-borosilicate glass having a mean particle size of less than about 1 μm. The first coating of the insulator typically has a thickness of about 0.05 mm to about 0.09 mm (2–3.5 mils).

The frame 44, including the coated first metal strands 40, is dried at room temperature. After drying, the first coating of the insulator material 64 is hardened (sintered) by heating the frame and the first metal strands 40, in an oven. The frame 44 is heated over a period of about 30 minutes to a temperature of about 250° C., and held at 250° C., for about 20 to 60 minutes. This first dwell step removes organic substances added to the insulator suspension.

After the first dwell step, the temperature of the oven is increased to about 420° C. over a period of about 20 minutes, and held at that temperature for about one hour to melt and crystallize the first coating of the insulator material 64 on the first metal strands 40. Thereafter, the temperature of the oven is increased to about 460° C. and held at that temperature for about 30 minutes to stabilize the structure for subsequent tube fabrication steps. The first coating of the insulator material 46, after crystallization, will typically not remelt at normal process temperatures. The first coating of the insulator material 64 is typically dome-shaped and has a thickness within a range of about 0.05 mm to about 0.09 mm (2–3.5 mils) across each of the strands 40.

After the first coating of the insulator material 64 is fired, a second coating of the insulator material 66 is applied over the first coating of the insulator material 64. The second coating of the insulator material 66 may have the same composition as the first coating. The second coating of the insulator material 66 has a thickness of about 0.005 mm to about 0.025 mm (0.2–1 mil).

Thereafter, the second metal wires 60 are applied to the frame 44, over the second coating of the insulator material 66, such that the second metal wires 60 are substantially perpendicular to the first metal strands 40. The second metal wires 60 are applied using a winding fixture (not shown) that accurately maintains a desired spacing of for example, about 0.33 mm (13 mils) between adjacent metal strands for a color CRT having a diagonal dimension of about 68 cm (27 V).

The frame 44, including the winding fixture, is heated to bond the second metal wires 60 to the second coating of the insulator material 66. The second coating of the insulator material 66 is heated according to the same process temperatures described above with reference to the first coating of the insulator material 64.

After the second coating of the insulator material 66 is sintered, the frame 44 is taken out of the holding device, electrical connections are made to the first and second strands 40, 60, and the focus mask 25 is inserted into a tube envelope.

What is claimed is:

1. A method of manufacturing a cathode-ray tube comprising an evacuated envelope having therein an electron gun for generating an electron beam, a faceplate panel having a luminescent screen with phosphor elements on an interior surface thereof, and a focus mask, wherein the focus mask includes a plurality of spaced-apart first conductive strands, and a plurality of spaced-apart second conductive wires oriented substantially perpendicular to the plurality of spaced-apart first conductive strands, comprising the steps of:

applying an insulating material to the plurality of spaced-apart first conductive strands, wherein the insulating material comprises a low porosity lead-zinc-borosilicate glass formed from a lead-zinc-borosilicate glass powder having a median particle size less than about 1 μm; and bonding the plurality of spaced-apart second conductive wires to the insulating material.

2. The method of claim 1 wherein the low porosity lead-zinc-borosilicate glass includes one or more transition metal oxides.

3. The method of claim 2 wherein the one or more transition metal oxides are selected from the group consisting of iron oxide ($Fe_2O_3$ and $Fe_3O_4$), titanium oxide ($TiO_2$), zinc oxide (ZnO), molybdenum oxide ($MoO_3$), chromium oxide ($Cr_2O_3$), tin oxide ($SnO_2$), nickel oxide (NiO), and combinations thereof.

4. The method of claim 2 wherein the one or more transition metal oxides in the low porosity lead-zinc-borosilicate glass have a weight % in a range of about 2% by weight to about 12% by weight.

5. The method of claim 1 wherein the low porosity lead-zinc-borosilicate glass is SCC-11, or a mixture of lead, zinc, boron and silicon oxides melted together to form an SCC-11 -like glass.

6. The method of claim 2 wherein the one or more transition metal oxides are added to the low porosity lead-zinc-borosilicate glass either by premelting or by mixing with the lead-zinc-borosilicate powder.

* * * * *